252-95 AU 166 EX
1/23/79 XR 4,136,038

United States Patent [19]

Pracht et al.

[11] 4,136,038

[45] * Jan. 23, 1979

[54] FABRIC CONDITIONING COMPOSITIONS CONTAINING METHYL CELLULOSE ETHER

[75] Inventors: Hans J. Pracht, Cincinnati; Michael E. Burns, West Chester, both of Ohio

[73] Assignee: The Procter & Gamble Company, Cincinnati, Ohio

[ * ] Notice: The portion of the term of this patent subsequent to Jul. 11, 1995, has been disclaimed.

[21] Appl. No.: 654,432

[22] Filed: Feb. 2, 1976

[51] Int. Cl.[2] ..... D06M 13/34

[52] U.S. Cl. ..... 252/8.8; 252/8.9; 252/DIG. 15; 252/95; 252/99

[58] Field of Search ..... 252/94, 95, 99, 8.8, 252/8.9, DIG. 15, 89

[56] References Cited

U.S. PATENT DOCUMENTS

| | | | |
|---|---|---|---|
| 3,664,961 | 5/1972 | Norris | 252/99 |
| 3,843,395 | 10/1974 | Morton | 427/272 |
| 3,920,561 | 11/1975 | Desmarais | 252/8.9 X |
| 3,928,213 | 12/1975 | Temple et al. | 252/8.9 X |
| 4,000,093 | 12/1976 | Nicol et al. | 252/531 |

*Primary Examiner*—Mayer Weinblatt
*Attorney, Agent, or Firm*—Richard C. Witte; Julius P. Filcik; Thomas H. O'Flaherty

[57] ABSTRACT

Fabric conditioning compositions contain a cellulose ether having a molecular weight of from 3,000 to 10,000 and a methyl degree of substitution of from 1.8 to 2.7. The presence of the cellulose ether provides a soil release benefit to fabrics contacted with the disclosed compositions.

10 Claims, No Drawings

FABRIC CONDITIONING COMPOSITIONS CONTAINING METHYL CELLULOSE ETHER

BACKGROUND OF THE INVENTION

This invention relates to fabric conditioning compositions containing a cellulose ether as a soil release agent. More particularly, this invention relates to the use of cellulose ethers having a low molecular weight and a high degree of methyl substitution. Fabric conditioning compositions containing the cellulose ether give soil release properties to fabrics contacted therewith, thereby rendering the fabrics easier to clean in subsequent washings.

Cellulose ethers are a well known class of materials. They are generally derived from vegetable tissues and fibers, including especially cotton and wood. The molecular weight of such cellulose ethers vary from about 19,000 to about 185,000. The molecular weight of the cellulose materials can be reduced by various means including aqueous acid hydrolysis, oxidative depolymerization, and by reaction with gaseous hydrogen chloride. For example, see U.S. Pat. No. 3,391,135, July 2, 1968, Ouno et al, and British Pat. No. 1,139,637, published Jan. 8, 1969. Changing the molecular weight of a cellulose ether necessarily affects its physical properties.

The hydroxyl groups of the anhydroglucose unit of cellulose can be reacted with various agents thereby replacing the hydrogen of the hydroxyl with the reacting agent. For example, various alkylating and hydroxyalkylating agents have been reacted with cellulose materials to produce alkyl cellulose ethers and hydroxyalkyl cellulose ethers. The degree of substitution may vary up to 3.0 since there are three available positions on each anhydroglucose unit. The kind of substitution and degree thereof also has an effect on the physical properties of the cellulose material.

Fabric conditioning compositions containing various soil release agents are known. For example, see U.S. Pat. No. 3,920,561, DesMarais, issued Nov. 18, 1975 and U.S. Pat. No. 3,928,213, Temple et al., issued Dec. 23, 1975. While certain of the prior art cellulose ethers have been able to efficiently and effectively deposit upon fabrics and thus provide a soil release benefit, there are consequent negatives involved. It has been found that deposition of certain of the prior art cellulose ethers on fabrics causes a negative in particulate soil removal. More specifically, when such treated fabrics are subsequently stained with a particulate soil, e.g. clay, and washed, the stain is more difficult to remove. It is believed the cellulose ether provides a bonding site for the particulate soil, thus causing its removal to be more difficult.

It is an object of this invention to provide fabric conditioning compositions which impart soil release properties to fabrics without causing particulate soil removal negatives.

Still another object of this invention is to provide fabric conditioning compositions which impart oily soil release properties to fabrics and are formulated to be added to the washing machine.

These and other objects of the invention will become apparent from the description to follow.

As used herein, all percentages and ratios are by weight unless otherwise indicated.

SUMMARY OF THE INVENTION

A fabric conditioning composition having the ability to impart an oily soil release benefit to fabrics contacted therewith consists essentially of (a) from 0.05% to 10% of a methyl cellulose ether having a DS methyl of from 1.8 to 2.7 and a molecular weight of from 3,000 to 10,000 and (b) the balance a carrier. Such a composition can contain a builder, bleach, enzyme, water, etc. and is useful as a pre-soak laundry composition or as a rinse additive composition.

DETAILED DESCRIPTION OF THE INVENTION

The compositions of this invention are useful in conjunction with a home laundering operation.

A wash cycle in a home can comprise (1) a pre-wash where soils and stains on fabrics are broken down over a prolonged period; (2) a main wash cycle wherein a detergent composition is used to remove the soils and stains; and (3) a rinse cycle where the cleaned fabrics are provided with some desirable attribute, commonly softness. The resultant fabrics are spin-dried in the washing machine and subsequently dried, normally in an automatic clothes dryer. The compositions of this invention are useful in any of the above-described cycles.

The cellulose ethers of this invention have a low molecular weight and a high degree of methyl substitution. The cellulose ethers have the following structure.

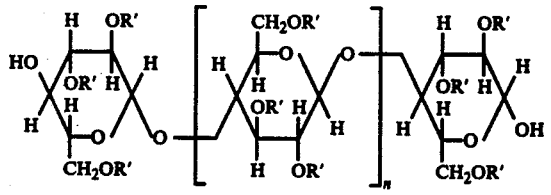

wherein R′ is hydrogen or methyl with the proviso that the average degree of methyl substitution on the anhydroglucose unit is from 1.8 to 2.7; n in the above formula ranges from 14 to 54. This corresponds to a molecular weight of from 3,000 to 10,000 as measured by known ultracentrifuge techniques. Preferably the molecular weight ranges from 3500 to 8000, more preferably from 4000 to 5500. Concurrently filed patent application Ser. No. 654,431, "Novel Cellulose Ethers and Detergent Compositions Containing Same," Burns and Pracht, discloses and claims the above-described cellulose ethers.

Natural cellulose materials such as wood pulp, cotton linters, etc. have a molecular weight ranging from 250,000 to 1,000,000 or greater. The cellulose ethers of this invention are prepared from the natural cellulose materials. The cellulose material is methylated and then has its degree of polymerization reduced or it is initially reduced in degree of polymerization and then methylated.

Known processes for methylating cellulose are used. Such processes involve, for example, simply combining methyl chloride with the cellulose under alkaline conditions. Such a process results in a degree of substitution (DS) methyl of below 2 and most generally a DS methyl of about 1.5. Higher degrees of methyl substitution are obtained by exhaustive methylation of cellulose using a methyl halide, preferably methyl chloride and caustic, preferably sodium hydroxide in a pressure vessel in a manner well known in the art for preparing the lower degrees of methyl substituted celluloses; the methylation procedure is simply repeated and continued until the desired degree of substitution is secured. The progress of the methylation reaction is monitored by periodically sampling the reaction product and determining the degree of methylation. The cellulose ethers of this invention have a DS methyl of from 1.8 to 2.7, preferably from 2.1 to 2.4.

The methyl cellulose ether then has its degree of polymerization reduced by a gaseous hydrogen chloride, aqueous acid hydrolysis or oxidative depolymerization step.

When the gaseous hydrogen chloride step is used, the methyl cellulose ether (in a comminuted or powder form) is reacted with the hydrogen chloride at a level less than 5%, preferably about 2% by weight of the methyl cellulose ether. The reaction is carried out at a temperature of from 30° C. to 80° C. The amount of hydrogen chloride, reaction temperature and reaction time are adjusted to get the desired depolymerization. Further details as to this process step are found in U.S. Pat. No. 3,391,135, Ouno, et al, July 2, 1968, the disclosure of which is herein incorporated by reference.

Aqueous acid hydrolysis of cellulose ethers with resultant depolymerization is well known. Basically, a solution of the methyl cellulose ether is reacted with an aqueous acid, e.g. hydrogen chloride or phosphoric acid. The temperature of reaction varies from 20° C. to 100° C. The length of time the reaction is allowed to proceed is dependent upon the acid concentration, reaction temperature, degree of polymerization of the starting reactant and depolymerization desired. Generally, a reaction time of from 5 minutes to 2 hours results in a methyl cellulose ether having the desired molecular weight.

Oxidative depolymerization using periodic acid is also used to reduce the molecular weight of the methyl cellulose ether. Periodic acid is reacted with the methyl cellulose ether at a temperature of from 20° C. to 90° C. for 30 minutes to 24 hours, said conditions being dependent upon acid strength and degree of depolymerization desired. The resultant methyl cellulose ether prepared in this manner is preferably used in neutral pH compositions. Other known oxidation depolymerization reactions such as those using oxygen gas or hydrogen peroxide can be used.

Methyl cellulose ethers having the desired molecular weight and DS methyl are also prepared by initially reducing the molecular weight of alkali cellulose and then methylating. Natural cellulose is mixed with an alkali source, e.g., sodium hydroxide to produce alkali cellulose and thereafter aged until the desired molecular weight is obtained. The aging process is accelerated by passing oxygen through the alkali cellulose or by adding hydrogen peroxide to it. Such oxidative processes are well know. The resultant cellulose is then methylated to a DS methyl of at least 1.8 in the manner above described.

The above described methyl cellulose ethers are useful as a component of a fabric conditioning composition. The cellulose ether acts as an oily soil release agent. It effectively and efficiently deposits from a wash solution onto fabrics. When the fabrics are subsequently soiled and washed, the presence of the cellulose ether allows the soil to be more easily removed. Unexpectedly, the ease of removing particulate soil, especially clay, is not affected adversely by the presence of the instant cellulose ether (as opposed to prior art cellulose ethers) on the fabrics. It is believed particulate soil is less tightly bound to the low molecular weight high DS methyl cellulose ethers herein and thus are removed more easily. The compositions herein are especially useful in imparting a soil release benefit to synthetic fabrics, e.g. nylon and polyester fabrics.

Fabric conditioning compositions intended for use in a home laundering operation contain the above-described cellulose ether and a carrier. The selection of the carrier depends upon the particular end use to be made of the composition. If only a soil release benefit is to be added to the fabrics, the carrier is an inert material; however, the carrier can perform a building, bleaching, softening, etc. function if such attributes are desired. The carrier material can be a solid organic or inorganic material as well as a liquid material, e.g. water.

One suitable fabric conditioning composition is a pre-soak composition. Pre-soak compositions are added to a wash load such as to normally provide from 1000 ppm to 5000 ppm of the composition. Fabrics are allowed to soak for from 1 to 24 hours, generally at room temperature. Soils on the fabrics are degraded or loosened, thereby making their removal during the main wash easier. After the soak period, the water is removed and the normal wash cycle is begun.

A fabric pre-soak composition prepared in the manner of this invention contains from 0.05% to 10%, preferably 1.0% to 10% of the cellulose ether and from 10% to 80% preferably from 20% to 60% of a detergency builder, and the balance inert filler salts. Any of the known compounds possessing builder properties are useful herein. U.S. Pat. No. 3,664,961, May 23, 1972, Norris, Column 9, lines 4–35, describes suitable detergency builders (the disclosure in this patent is herein incorporated by reference). Suitable detergency builders also include the water-insoluble aluminum silicates described in German Patent Application 2,422,655 Corkill et al, published Nov. 28, 1974 (the disclosure of which is herein incorporated by reference). Suitable inert filler salts include sodium sulfate, sodium chloride, potassium acetate, and sodium silicate.

Preferred fabric pre-soak compositions also contain from 1% to 45%, preferably from 10% to 30% of a bleach. Suitable bleaches include the organic and inorganic peroxygen bleaches. Typical examples of suitable organic peroxyacids include the following: diperadipic acid, perphthalic acid and diperisophthalic acid. Inorganic bleaches include sodium perborate and sodium perborate tetrahydrate.

The pre-soak compositions herein also preferably contain from 0.05% to 2.0%, preferably 0.1% to 1.0% of a detergency enzyme. Typical enzymes include the various proteases, lipases, amylases and mixtures thereof.

Rinse additive compositions contain the above-described cellulose ether along with a carrier. Such compositions are added after the main wash cycle for the purpose of imparting a soil release benefit to the washed fabrics. The carrier can be a solid material such as the above-described detergency builders and/or inert filler salts. Such compositions contain from 0.1% to 10%, preferably 0.25% to 5% of the methyl cellulose ether and the balance the detergency builder and/or filler salts or a liquid carrier. Preferably the carrier is a liquid, for example, water. A preferred carrier is a water and lower alcohol mixture in a ratio of 95:5 to 85:15. Suitable lower alcohols include ethanol, propanol, isopropanol and butanol.

The rinse additive composition preferably additionally contains from 1% to 30%, preferably 2% to 25% of a water-insoluble organic fabric softener compound for imparting a softness attribute to the fabrics. Such compounds are described in U.S. Pat. No. 3,843,395, Oct. 22, 1974, Morton, 1974, at column 5, Line 55 through column 14, line 12, the disclosure of which is hereby incorporated by reference. These compounds are characterized by a melting point above 38° C. Preferred compounds melt at temperatures from 45° C. to 70° C. Preferred softening compounds are the cationic quaternary ammonium salts and the sorbitan esters. Suitable quaternary ammonium salts include ditallowalkylammonio chloride, bromide and methylsulfate.

The compositions can also contain a surfactant in non-deterging amounts, that is, from 0.05% to 2.0%, preferably 0.25% to 1%. The surfactant is employed in the compositions to help disperse the composition throughout the aqueous bath. Anionic or nonionic surfactants are used with the selection dependent upon the other components in the composition. Nonionic surfactants, especially the ethoxylated phenols and ethoxylated alcohols are preferred. The ethoxylated phenols are produced by condensing one mole of an alkylphenol wherein the alkyl chain contains from 8 to 18 carbon atoms with from 1 to 100 moles of ethylene oxide. The ethoxylated alcohols are produced by condensing one mole of a $C_{10}$–$C_{24}$ aliphatic alcohol with from 1 to 100 moles of ethylene oxide.

It should be understood that while the compositions can be used in the pre-wash or rinse, depending on their formulations, they can be added to the main wash to supplement the normally used detergent composition. In such cases, the carrier can be an inert carrier, but preferably is a builder material. The preferred compositions supplement the detergency builder action and provide fabric conditioning benefits.

Other additives such as perfumes, brightening agents, shrinkage controllers, and spotting agents, can be added to the compositions of this invention.

The following examples are illustrative of the invention.

EXAMPLE I

A laundry pre-soak composition has the following formula:

| Component | |
|---|---|
| Methyl cellulose ether (DS methyl = 2.1 and molecular weight = 6000) | 4% |
| Sodium tripolyphosphate | 65% |
| Sodium sulfate | 31% |

The composition is prepared by simply dry blending the individual components until a homogeneous granular powder is obtained.

Two ounces of the composition is added to 5 gallons of water at a temperature of 38° C. Five pounds of heavily soiled mixed fabrics are immersed in the water and are allowed to stand over night. Thereafter the fabrics are removed and laundered using a commercial detergent composition. The fabrics are rinsed and thereafter dried in an automatic clothes dryer. Following this treatment it is found that the fabrics when subsequently soiled with a variety of oily soils are more easily cleaned than similar fabrics soiled with the same oily materials but not having been treated with the laundry pre-soak composition as above identified.

The composition of this example is also useful as a detergent composition additive. That is, during the main wash cycle of a home laundering operation, a ca ½ cup of a conventional detergent composition and ca ½ cup of the composition above identified are added to the washing machine. The washed fabrics have imparted to them an oily soil release benefit.

EXAMPLE II

A laundry pre-soak composition is as follows:

| Component | |
|---|---|
| Methyl cellulose ether (DS methyl = 2.3 and molecular weight = 4500) | 2% |
| Sodium tripolyphosphate | 31.5% |
| Sodium perborate . 4 $H_2O$ | 20.0% |
| Proteolytic enzyme | 0.3% |
| Brightener, dye, perfume and water | Balance |

The composition of this example is prepared by simply dry mixing the individual components until a homogeneous granular product is obtained.

Satisfactory oily soil release is imparted to fabrics by the use of the above identified composition.

EXAMPLE III

A rinse-added fabric softener composition is formulated as follows: 5.0 grams of a methyl cellulose ether of Example I and 10.0 gram of ditallow alkyl dimethyl ammonium chloride are suspended in 200 milliters of a 90:10 water-ethanol mixture.

45 milliters of the foregoing composition are added to 5 pounds of fabrics in 15 gallons of water. The fabrics are agitated 5 minutes and spun dried. After drying the fabrics are found to be provided with a soft anti-static finish and additionally possess a soil release benefit. That is, when the fabrics are subsequently soiled and washed, the soils are more easily removed than fabrics treated in the same manner except for the absence of the methyl cellulose ether in the rinse-added composition.

What is claimed is:

1. A fabric conditioning composition having the ability to impart an oily soil release benefit to fabrics contacted therewith consisting essentially of: (a) from 0.05% to 10% by weight of a methyl cellulose ether having the structure

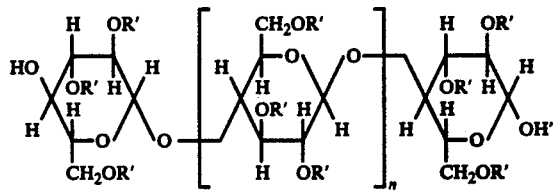

wherein R' is hydrogen or methyl and n ranges from 14 to 54, having a DS methyl of from 1.8 to 2.7 and a molecular weight of from 3000 to 10,000; (b) from 10% to 80% by weight of a detergency builder; and (c) the balance an inert filler.

2. The fabric conditioning composition of claim 1 wherein the methyl cellulose ether has a molecular weight of from 3500 to 8000.

3. The fabric conditioning composition of claim 2 wherein the molecular weight is from 4000 to 5500 and the DS methyl is from 2.1 to 2.4.

4. The fabric conditioning composition of claim 1 wherein the methyl cellulose ether represents from 0.1% to 10% of the composition and additionally contains from 1% to 30% of a water-insoluble organic fabric softener compound having a melting point above 38° C.

5. The fabric conditioning composition of claim 4 wherein the softener compound represents from 2% to 25% of the composition.

6. A fabric conditioning composition having the ability to impart an oily soil release benefit to fabrics contacted therewith consisting essentially of: (a) from 0.1% to 10% by weight of a methyl cellulose ether having the structure:

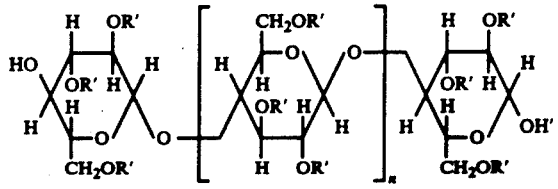

wherein R' is hydrogen or methyl and n ranges from 14 to 54, having a DS methyl of from 1.8 to 2.7 and a molecular weight of from 3000 to 10,000; (b) from 1% to 30% by weight of a water-insoluble organic fabric softener compound having a melting point above 38° C.; and (c) the balance a liquid carrier wherein said carrier is water or a water and alcohol mixture in a ratio of from 95:5 to 85:15 and wherein the alcohol is ethanol, propanol, isopropanol or butanol.

7. The fabric conditioning composition of claim 6 wherein the methyl cellulose ether has a molecular weight of from 3500 to 8000.

8. The fabric conditioning composition of claim 7 wherein the molecular weight is from 4000 to 5500 and the DS methyl is from 2.1 to 2.4.

9. The fabric conditioning composition of claim 6 wherein the softener compound represents from 2% to 25% of the composition.

10. The fabric conditioning composition of claim 9 wherein the softener compound is a quaternary ammonium salt.

* * * * *